US005520322A

United States Patent [19]

Conviser

[11] Patent Number: 5,520,322

[45] Date of Patent: May 28, 1996

[54] REGRESSIVELY-TIERED PACKAGE STRUCTURE

[76] Inventor: Rebecca F. Conviser, 27 Windmill Dr., Morristown, N.J. 07960

[21] Appl. No.: 430,398

[22] Filed: Apr. 28, 1995

[51] Int. Cl.[6] ..... B65D 5/32; B65D 5/42

[52] U.S. Cl. ..... 229/110; 229/116.1; 229/115; D9/430

[58] Field of Search ..... 229/23 BT, 104, 229/116.1, 117.12, 125.32, 110, 115; 220/4.21, 4.24; D9/414, 431, 432, 430; 446/75, 124, 125; D21/105, 108

[56] References Cited

U.S. PATENT DOCUMENTS

| | | | |
|---|---|---|---|
| 305,674 | 9/1884 | Dalzell | 220/4.21 |
| D. 313,752 | 1/1991 | Dyble | D9/432 |
| D. 328,706 | 8/1992 | Ruff | D9/430 |
| D. 332,399 | 1/1993 | Neff | D9/430 |
| D. 356,257 | 3/1995 | Wise | D9/431 |
| D. 359,904 | 7/1995 | Mabry | D9/432 |
| 2,050,894 | 8/1936 | Paige | 229/116.1 |
| 2,706,065 | 4/1955 | Stone | 220/4.21 |
| 2,729,383 | 1/1956 | King . | |
| 2,796,211 | 6/1957 | Wagner . | |
| 2,979,250 | 4/1961 | Hobbs . | |
| 3,021,042 | 2/1962 | Stumpf, Jr. . | |
| 3,389,851 | 6/1968 | Clark | 220/4.21 |
| 4,216,763 | 8/1980 | Miklas | 220/4.24 |
| 4,355,757 | 10/1982 | Roccaforte . | |
| 4,374,560 | 2/1983 | Howlett . | |
| 5,238,134 | 8/1993 | Knapp | 220/4.21 |

FOREIGN PATENT DOCUMENTS

| | | | |
|---|---|---|---|
| 2547559 | 12/1984 | France | 229/23 BT |

*Primary Examiner*—Gary E. Elkins
*Attorney, Agent, or Firm*—Amster, Rothstein & Ebenstein

[57] ABSTRACT

A regressively tiered structure defining at least part of a package includes first and second tiers and a ledge. The first vertically-extending tier defines in plan a first hollow, polygonal, substantially closed figure having edges. The second vertically-extending tier defines in plan a second hollow, polygonal, substantially closed figure having edges, the second figure being in plan of appreciably smaller dimensions than and typically of the same configuration as the first figure. The horizontally-extending, generally planar, ledge is disposed intermediate to and connecting the edges of the first and second tiers which are disposed in generally a common plane, the ledge defining a plurality of overlapping ledge sides. The first and second tiers and the ledge are formed from a single sheet of flexible material.

36 Claims, 14 Drawing Sheets

FIG. 5
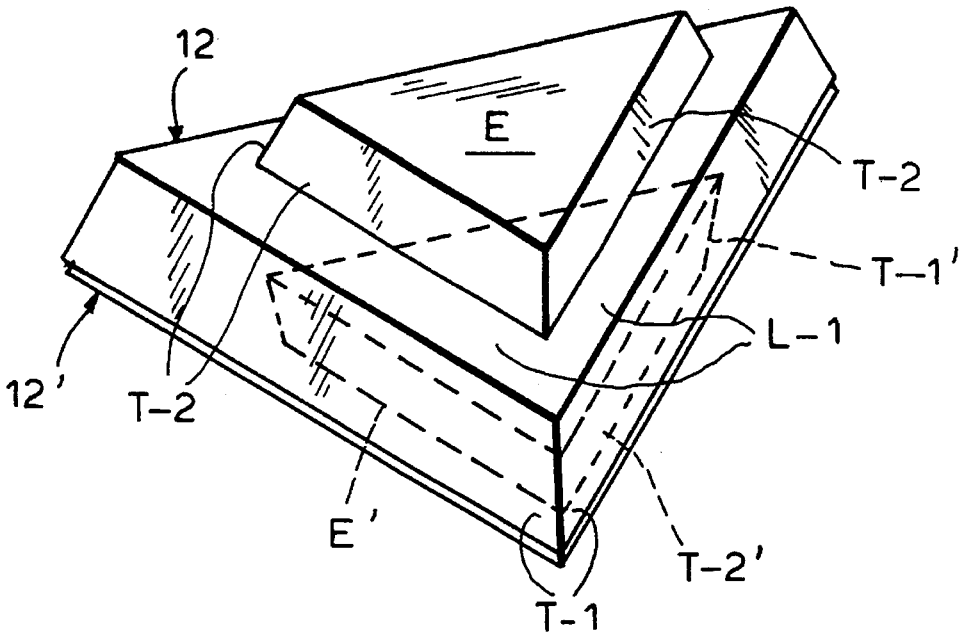
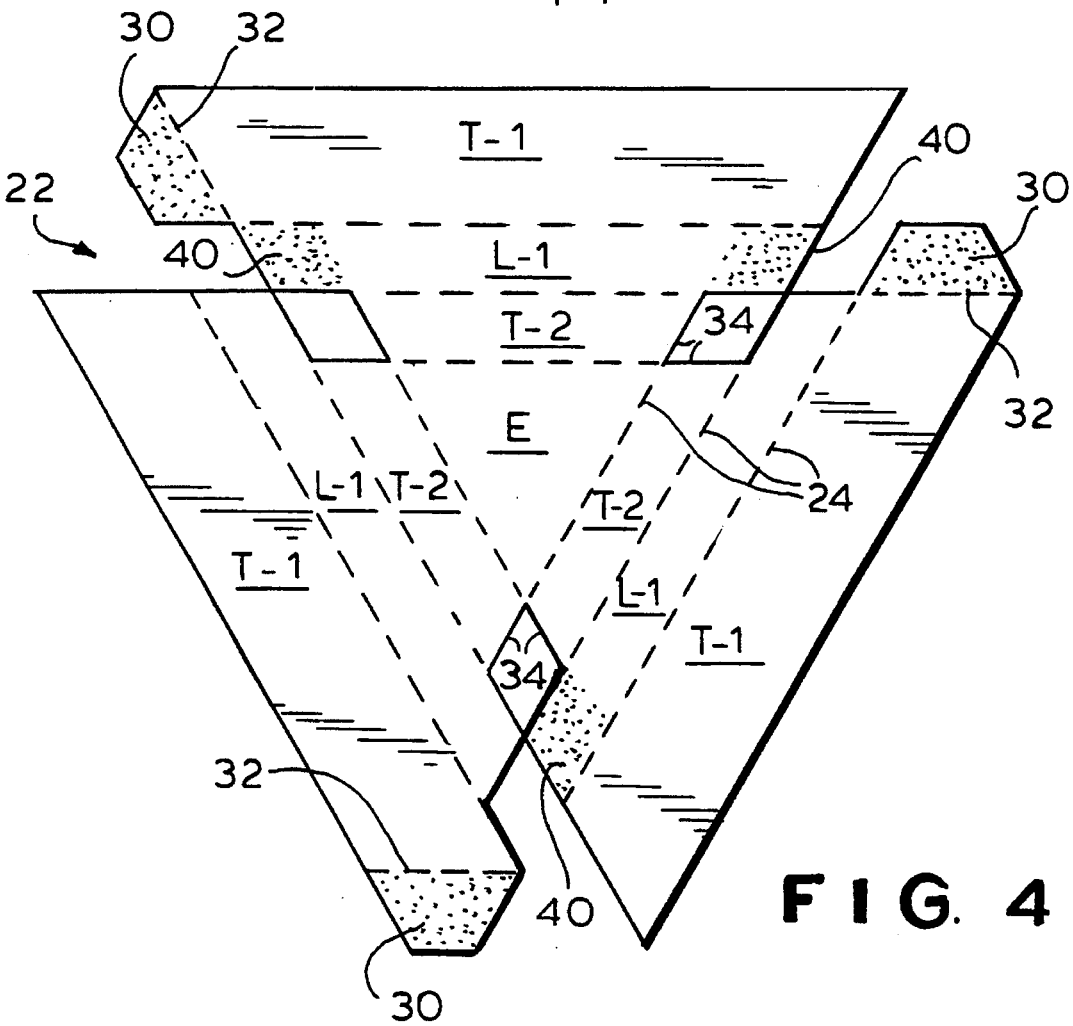
FIG. 4

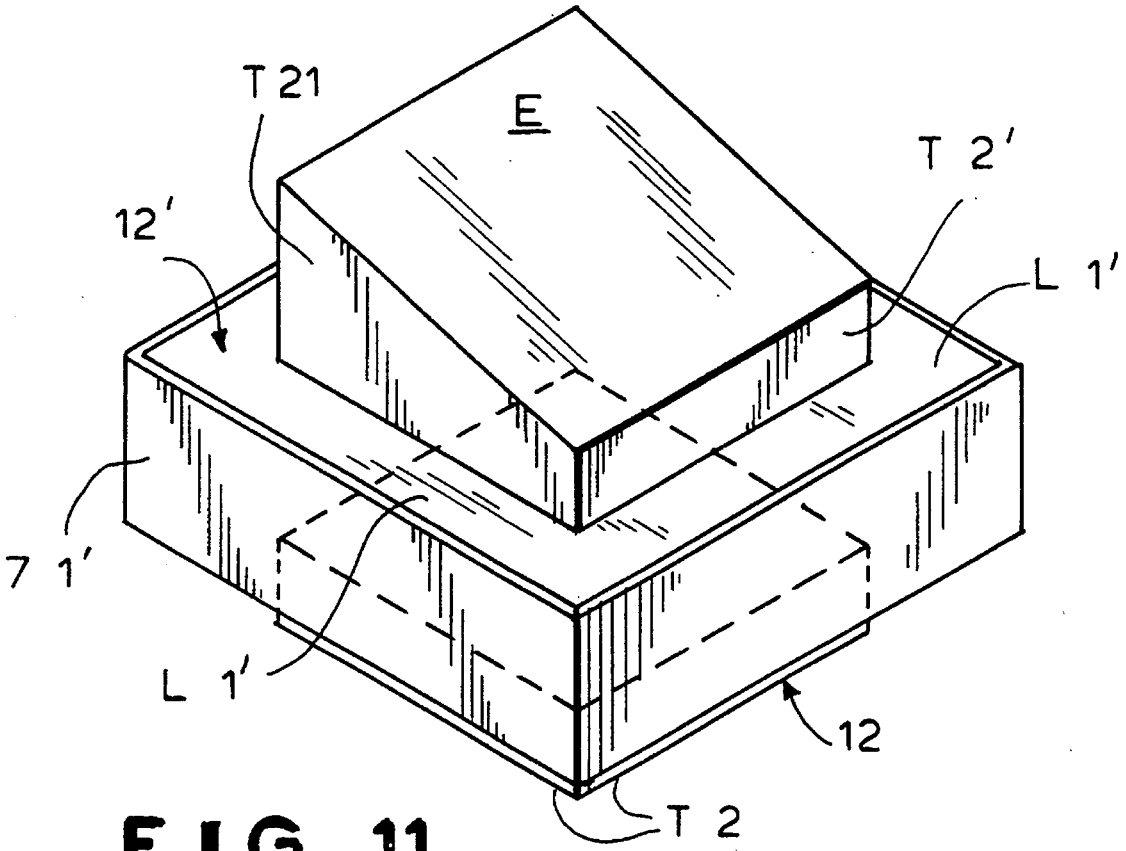
FIG. 11
FIG. 12
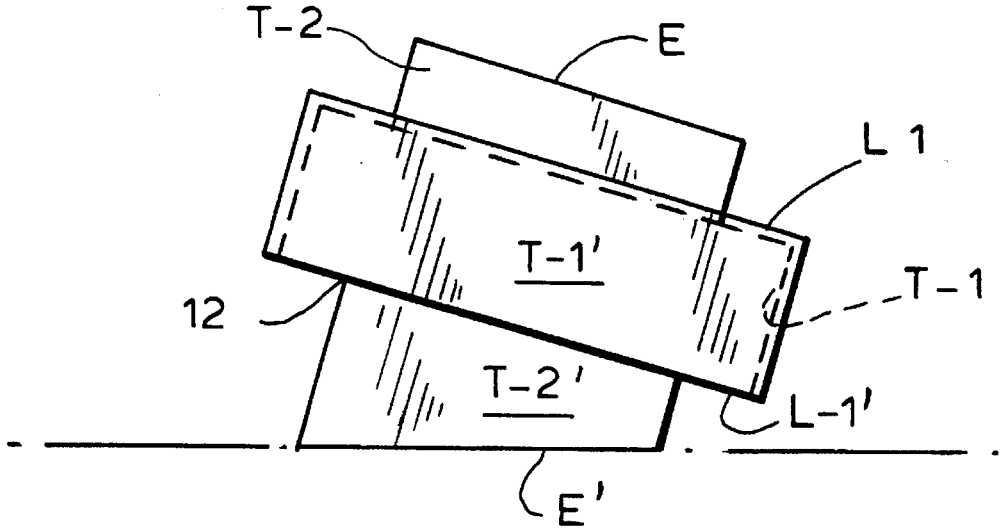

FIG 15
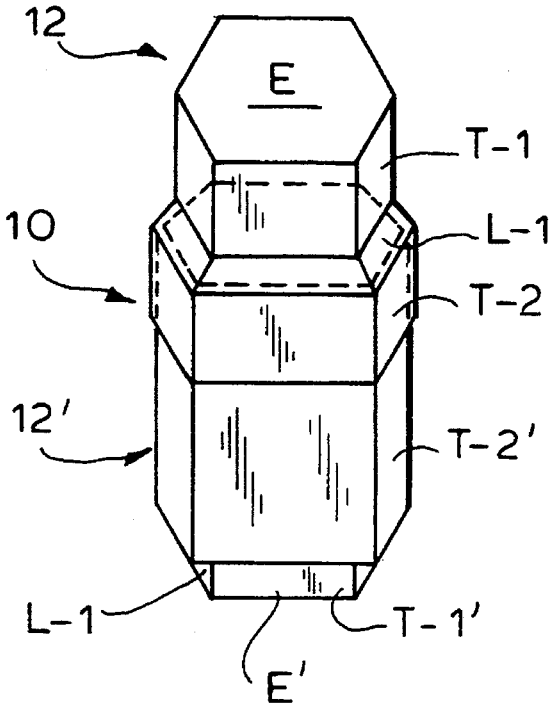
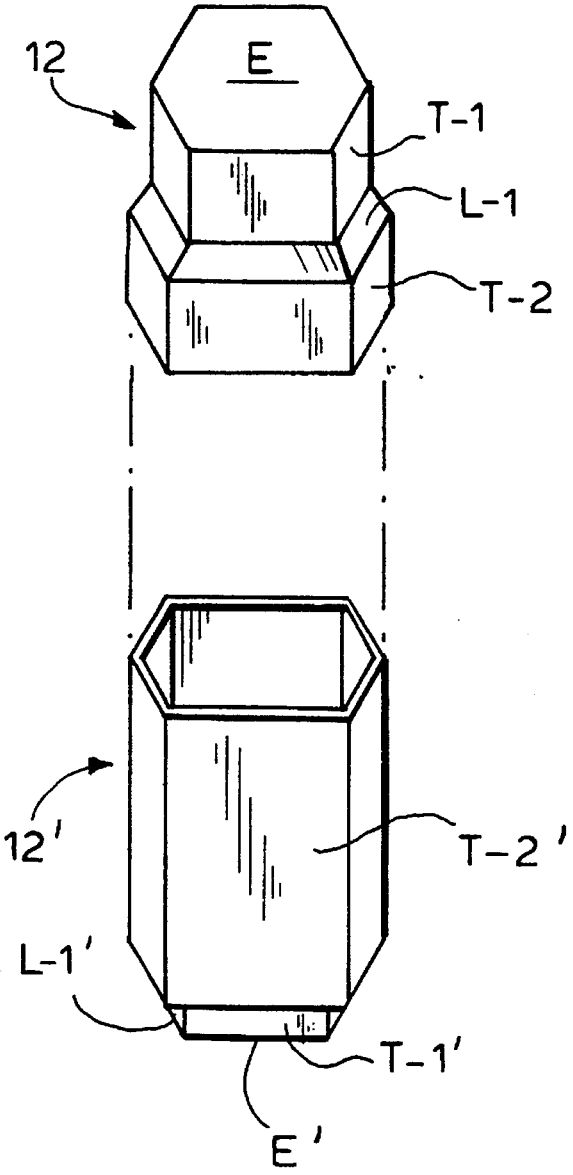
FIG. 16

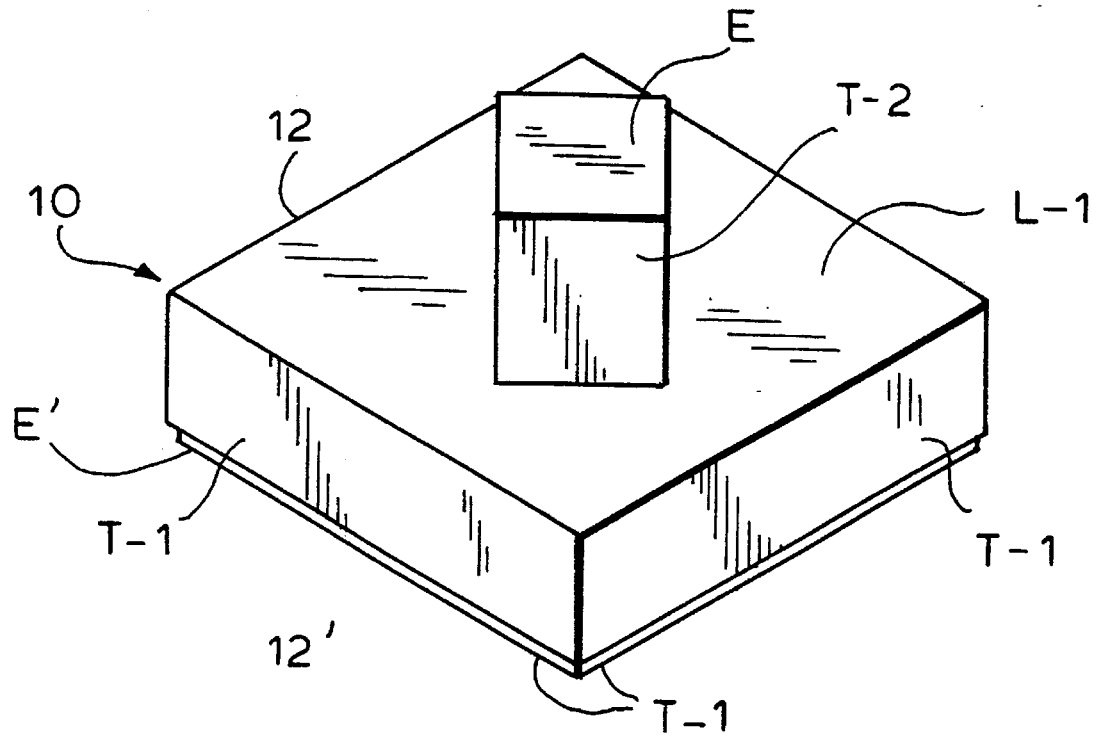
FIG. 21
FIG. 22
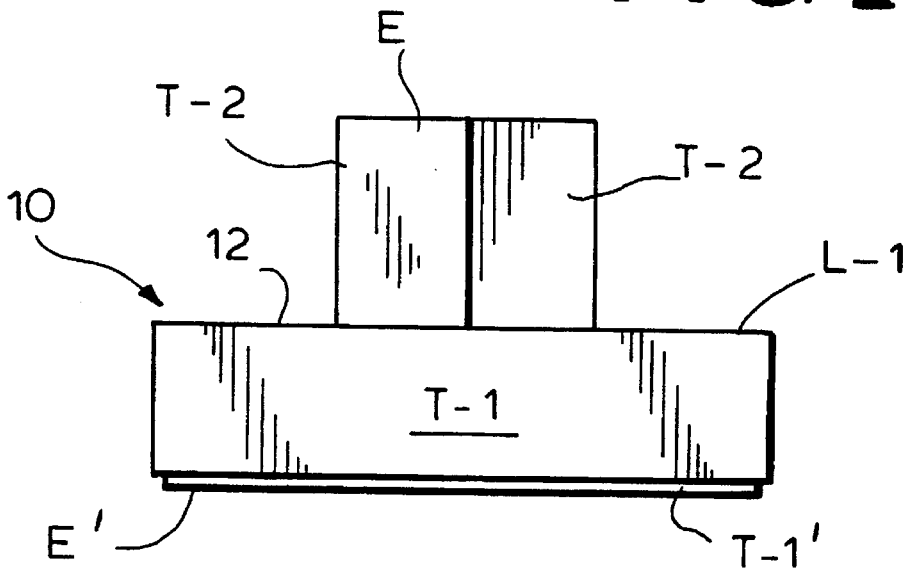

REGRESSIVELY-TIERED PACKAGE STRUCTURE

BACKGROUND OF THE INVENTION

The present invention relates to a package such as a display package, and in particular to such a package which includes a regressively-tiered structure.

As is well known to those in the marketing arts, the packaging in which a product is sold may determine the commercial success of the product more than any attributes of the product itself. The providers of packaging vie among themselves to produce the most innovative, eye-catching and attractive packaging consonant with the configuration and dimensions of the product, and, at least in some instances, the need to protect the product. Nonetheless, most packages are of rectangular parallele-piped configuration (that is, box-like configuration). Some packages define in plan a polygon other than a rectangle, but typically such packages are either substantially cylindrical or conical (whether truncated or not) in design or possessed of a plan design which is constant in both configuration and dimensions throughout the height of the package.

In many instances, the aesthetic demands on the packaging overwhelm what must be the essential function of the packaging—namely, the ability to be easily opened for removal of the contents therefrom. Thus, many of today's packages fail to provide adequate hand-grips or gripping extensions for opening of the packaging. The elderly, the arthritic, and many others simply do not find the two halves of an assembled package easily graspable in such a manner as to enable easy separation thereof. The use of packaging with a texture (e.g., with bumps or dimples) to facilitate grasping thereof may ameliorate the problem for certain users, but not for those who are unable to open or close their fingers about the plan dimensions of the package. The dimensions of the package may be so great that the hands of the user cannot find an adequate purchase on either of the halves as necessary to facilitate opening thereof. Where the two halves of the package at least partially telescope, it is frequently necessary to grasp and shake the outer half so as to allow for a separation therefrom of the inner half.

Finally, economic demands on mass-produced packaging dictate that the package be formed from a single sheet of material, or at least that each of the two halves be made from a single sheet of material.

Accordingly, it is an object of the present invention to provide an aesthetically innovative, eye-catching and appealing package.

Another object is to provide such a package in which each half thereof may be economically made from a single sheet of material.

A further object is to provide such a package which in one embodiment has ergonomic gripping extensions to facilitate opening of thereof.

It is also an object of the present invention to provide such a package which in one embodiment enables the inner volume of the gripping extensions to be occupied by the products being packaged.

It is a further object of the present invention to provide such a package in which each half thereof may be made in a variety of different configurations and dimensions, but still be recognizable by a common feature thereof.

SUMMARY OF THE INVENTION

It has now been found that the above and related objects of the present invention are obtained in a regressively-tiered structure defining at least part of a package, the structure comprising a first vertically-extending tier, a second vertically-extending tier, and a horizontally-extending first ledge, all formed from a single sheet of flexible material. The first vertically-extending tier is formed of sections and defines in plan a first hollow, polygonal, substantially closed figure having edges. The second vertically-extending tier is formed of sections and defines in plan a second hollow, polygonal, substantially closed figure having edges, the second figure being in plan of appreciably smaller dimensions than the first figure. The horizontally-extending, generally planar, first ledge is formed of sections and disposed intermediate to and connecting the edges of the first and second tiers disposed in generally the same plane. The first and second tiers and the first ledge are formed from a single sheet of flexible material.

Preferably the first and second figures are in plan of the same general configuration, and optimally of substantially the same configuration.

In a preferred embodiment, each of the first ledge sections defines a pair of ledge ends, each pair of adjacent ledge ends being overlapping. Each of the tier sections defines at least first and second ends. The first one of the tier ends defines a tab projecting therefrom at an angle and being secured to the second end of an adjacent tier for defining a joint of the tier. Alternatively, the ends of the first and second sides of adjacent tiers are disposed in generally abutting relationship to define a butt joint without being directly secured together.

The polygonal figures may be defined by substantially linear sides or by at least one convex side. The polygonal figures are triangles, rectangles, or the like or approximate circles. The first and second tiers are coaxially disposed along an axis passing therethrough. The first and second tiers may be angularly offset from one another in elevation or in plan, if desired. The tiers may be substantially vertical or at an acute angle to the vertical. The first ledge may be substantially horizontal or at an acute angle to the horizontal. The structure additionally includes a closed end for the second tier, the closed end also being formed from the single sheet of material. The second tier may be of a greater height than the first tier.

In another embodiment the structure additionally includes a third vertically-extending tier formed of sections and defining in plan a third hollow, polygonal, substantially closed figure having edges, the third figure being in plan of appreciably smaller dimensions than the second figure, and a horizontally-extending, generally planar second ledge formed of sections and disposed intermediate to and connecting the edges of the second and third tiers disposed in generally the same plane. The first, second and third tiers and the first and second ledges are formed from a single sheet of flexible material. The structure additionally includes a closed end for the third tier, the closed end also being formed from the single sheet of material. The first, second, and third figures may be of the same general configuration or substantially the same configuration.

The present invention also encompasses, in combination, a pair of the structures defining together a package. Preferably the first tier of one structure is adapted to be received at least partially within the first tier of the other structure, or one side of one structure defines with one side of the other structure a living hinge, thereby to enable a clam shell-like opening and closing of the package.

The present invention further encompasses a package with a gripping extension comprising a container and a cover. The hollow container has an open top and defines an open space therein. The cover is for closing the container open top, the cover having an open bottom and defining an open space therein. The cover is in plan of the same general configuration and generally the same dimensions as the container. A gripping extension is formed on one of the cover and the container for use in separating the cover and the container, the gripping extension being in plan of appreciably smaller dimensions than the one of the cover and container on which it is formed.

Preferably the gripping extension and the one of the cover and container on which it is formed are in plan of the same general configuration or of substantially the same configuration.

In a preferred embodiment, the gripping extension defines an open space therein. Preferably a gripping extension is formed on each of the cover and the container, with each of the gripping extensions defining an open space therein and the open spaces of the gripping extensions being in communication in the closed package through the container and the cover. The container and the gripping extension formed thereon are made from a single sheet of material, and the cover and the gripping extension formed thereon are made from a single sheet of material.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 4 is a top plan view of a blank for a modified triangular regressively tiered structure defining at least part of a display package;

FIG. 5 is an isometric view of a display package incorporating the modified triangular structure formed from the blank of FIG. 4;

FIGS. 11 and 12 are isometric and side elevational views, respectively, of a display package incorporating the structure formed from the blank of FIG. 10;

FIGS. 14, 15 and 16 are side elevational, isometric and exploded isometric views, respectively, of a display package incorporating the approximately circular structure formed from the blank of FIG. 13;

FIG. 21 and 22 are isometric and side elevational views, respectively, of a display package incorporating the structure formed from the blank of FIG. 20.

DETAILED DESCRIPTION OF THE PREFERRED EMBODIMENTS

Figure 1:
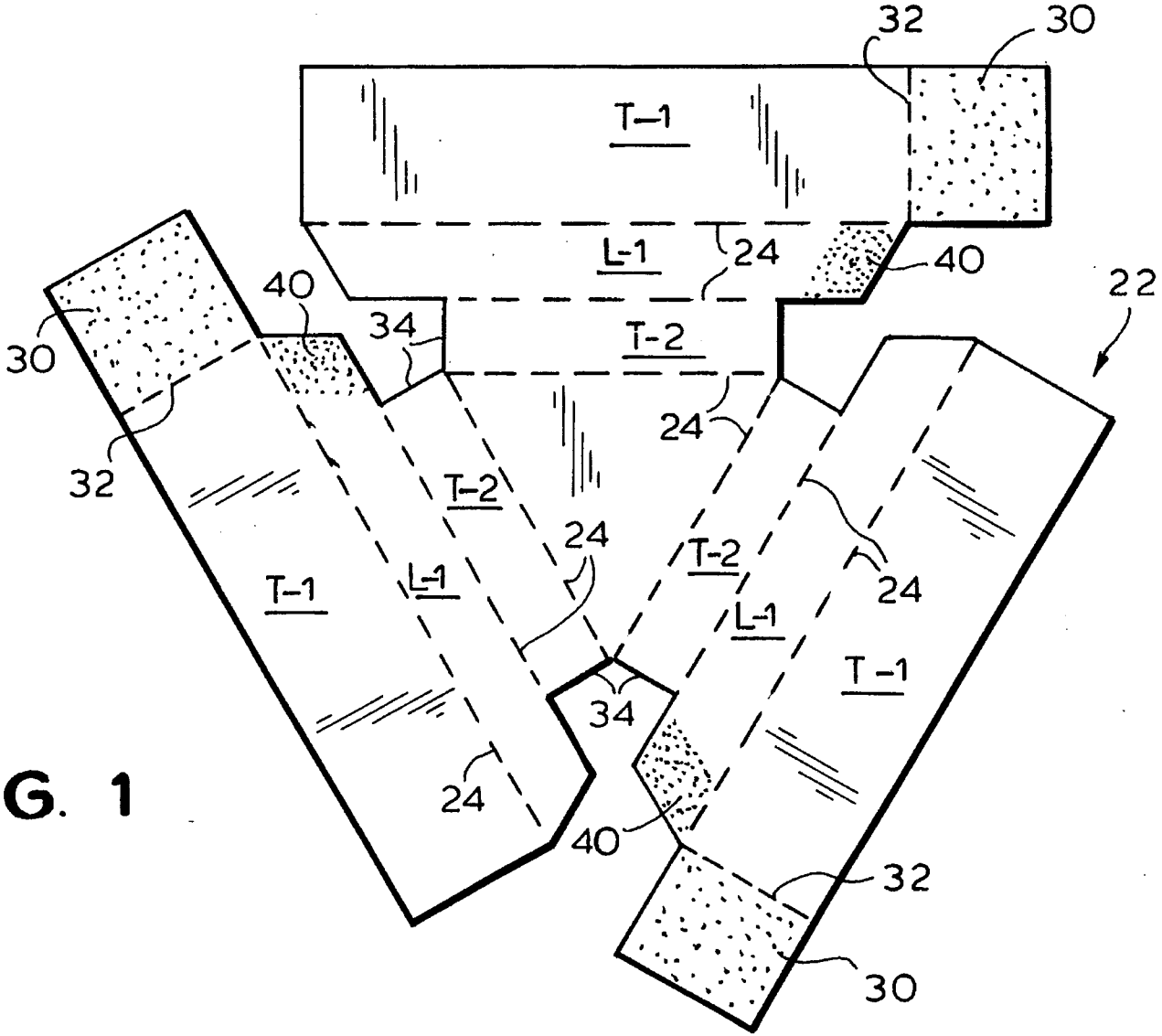
FIG. 1 is a top plan view of a blank for a triangular regressively tiered structure defining at least part of a display package.

The present invention comprises a regressively tiered structure defining at least part of a display package, generally designated by the reference numeral 10. The same package 10 also defines a package with a gripping extension.

Figure 2:
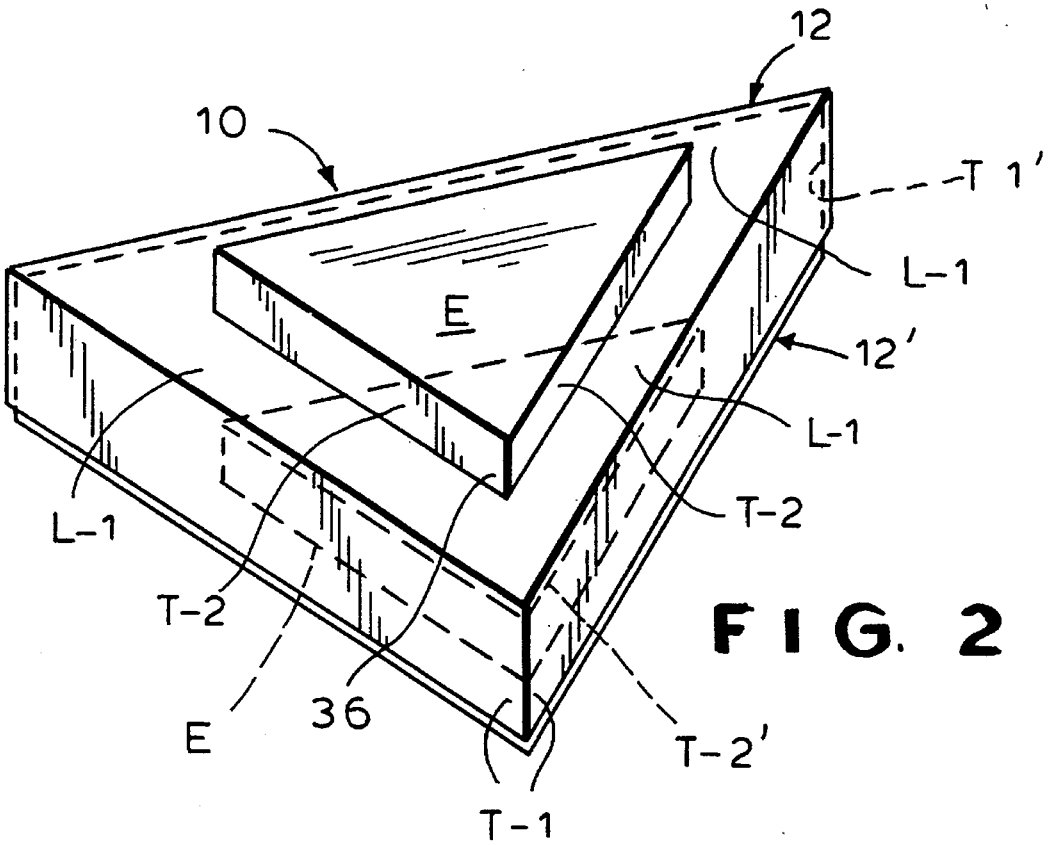
FIGS. 2 and 3 are isometric and side elevational views, respectively, of a display package incorporating the triangular structure formed from the blank of FIG. 1.
Figure 3:
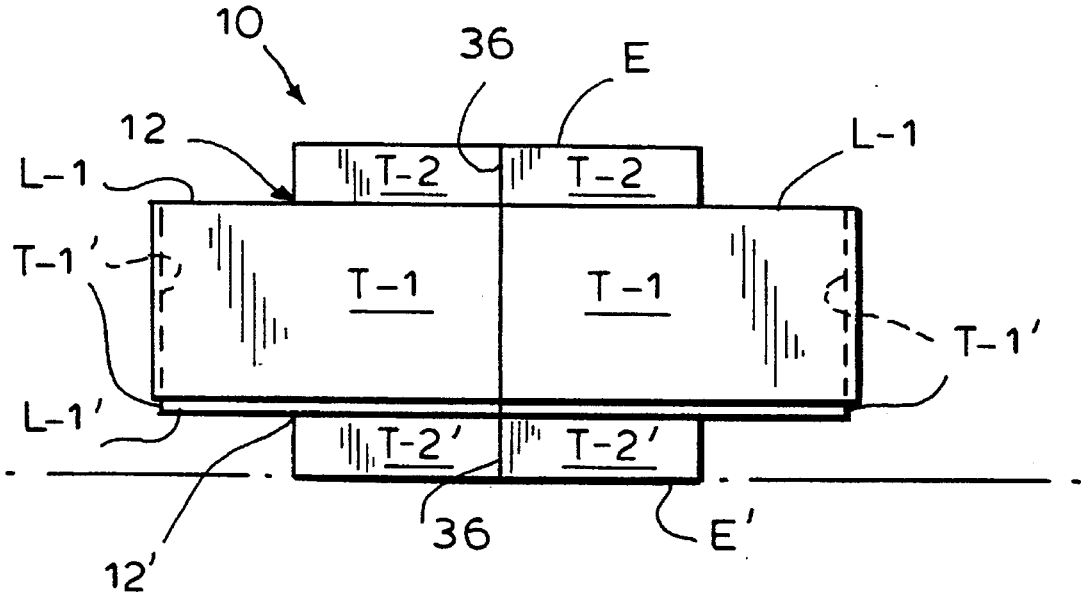

Referring now to FIGS. 2 and 3, therein illustrated is a triangular display package 10 defined by a pair of structures: a top structure 12 and a bottom structure 12'. At least one of the structures 12, 12' is reversely tiered; as illustrated in FIGS. 2 and 3, both structures 12, 12' are reversely tiered.

Top structure 12 includes a first vertically-extending tier T-1 formed of sections and defining in plan a first hollow, polygonal, substantially closed figure having edges; a second vertically-extending tier T-2 formed of sections and defining in plan a second hollow, polygonal, substantially closed figure having edges; and a horizontally-extending, generally planar, first ledge L-1 formed of sections and disposed intermediate to and connecting the edges of the first and second tiers T-1, T-2 disposed in generally the same plane. The first and second tier T-1, T-2 and the first ledge L-1 of top structure 12 are formed from a single sheet of flexible material, typically paperboard, cardboard, or the like. Bottom structure 12' includes a first vertically-extending tier T-1' formed of sections and defining in plan a first hollow, polygonal, substantially closed figure having edges; a second vertically-extending tier T-2' formed of sections and defining in plan a second hollow, polygonal, substantially closed figure having edges; and a horizontally-extending, generally planar, first ledge L-1' formed of sections and disposed intermediate to and connecting the edges of the first and second tiers T-1, T-2 disposed in generally the same plane. The first and second tier T-1, T-2 and the first ledge L-1 of top structure 12 are formed from a single sheet of flexible material, typically paperboard, cardboard, or the like. The polygons may be equilateral or not, as desired.

In order to provide the regressively tiered aspect of the present invention, in each regressively tiered structure 12, 12' the second figure (defined by the second tier T-2 or T-2') is in plan of appreciably smaller dimensions to the unaided eye than the first figure (defined by the first tier T-1 or T-1'). The first-and second figures are preferably in plan of the same general configuration and, most frequently, of substantially the same configuration. Thus, where the first figure is a triangular, quadrangle, pentagon, or the like, the second figure is of the same general configuration (that is, has the same number of sides). Further, the first and second figures are typically of substantially the same configuration or "similar" as that term is used in geometry—that is, have corresponding angles equal and corresponding line segments proportioned.

While the regressively tiered structures 12, 12' according to the present invention include at least first and second tiers T-1 and T-2 or T-1' and T-2' and a first ledge L-1 or L-1', either or both structures may additionally include a third vertically-extending tier T-3 or T-3' formed of sections and defining in plan a third hollow, polygonal, substantially closed figure having edges. The third figure (formed by the third tier) is in plan of appreciably smaller dimensions than the second figure (formed by the second tier). Further, a horizontally-extending, generally planar second ledge L-2 or L-2' formed of sections is disposed intermediate to and connects the edges of the second and third tiers T-2 and T-3 or T-2' and T-3' disposed in generally the same plane. In this instance, the first, second and third tiers T-1, T-2 and T-3 (or T-1', T-2' and T-3') and the first and second ledges L-1 and L-2 (or L-1' and L-2') are formed from a single sheet of flexible material. The third figure is preferably in plan of the same general configuration as the first and second figures and, most frequently, of substantially the same configuration.

As will be apparent to those skilled in the art of packaging, in either regressively tiered structure 12, 12', the number of tiers may be increased to T-N, with the number of ledges being correspondingly increased to L-(N minus 1). The number of tiers in the top structure 12 may be the same as the number of tiers in the bottom structure 12' (see FIGS. 1–5) or may differ in number (see FIGS. 7–10 where there are three tiers and two ledges in the top structure 12 and only two tiers and one ledge in the bottom structure 12').

The smallest tier (the second tier T-2 where there are two tiers only, the third tier T-3 where there are three tiers only, etc.) includes a closed end E or E' which is also formed from the single sheet of material used to form the tiers and ledge(s) of the structure. Thus, in the top structure 12 of the package 10, the closed end E for the smallest tier also acts as the closed top end of the package 10.

While the package 10 illustrated in FIGS. 2 and 3 is formed by two regressively tiered structures 12, 12', as already noted it is only necessary for one of the structures 12 or 12' forming the package 10 to be regressively tiered. However, the most interesting designs and the more easily opening packages are formed from two regressively tiered structures 12, 12'. Of course, the number of tiers and the number of ledges in each regressively tiered structure 12, 12' may differ (see, for example, the package of FIGS. 7–9).

For expository purposes, hereinafter references will be made to the top structure 12 (and the tiers and ledges thereof) as the regressively tiered structure (and the tiers and ledges thereof) although the same reference may be equally applicable to the bottom structure 12' (and the tiers and ledges thereof).

The various hollow, polygonal, substantially enclosed figures formed in plan by the tiers may be triangles (as illustrated in FIGS. 1–5), quadrangles or rectangles (as illustrated in FIGS. 6–9 and 10–12) and so on, until the figures approximate circles (as illustrated by the hexagonal figures in FIGS. 13–16).

Figure 10:
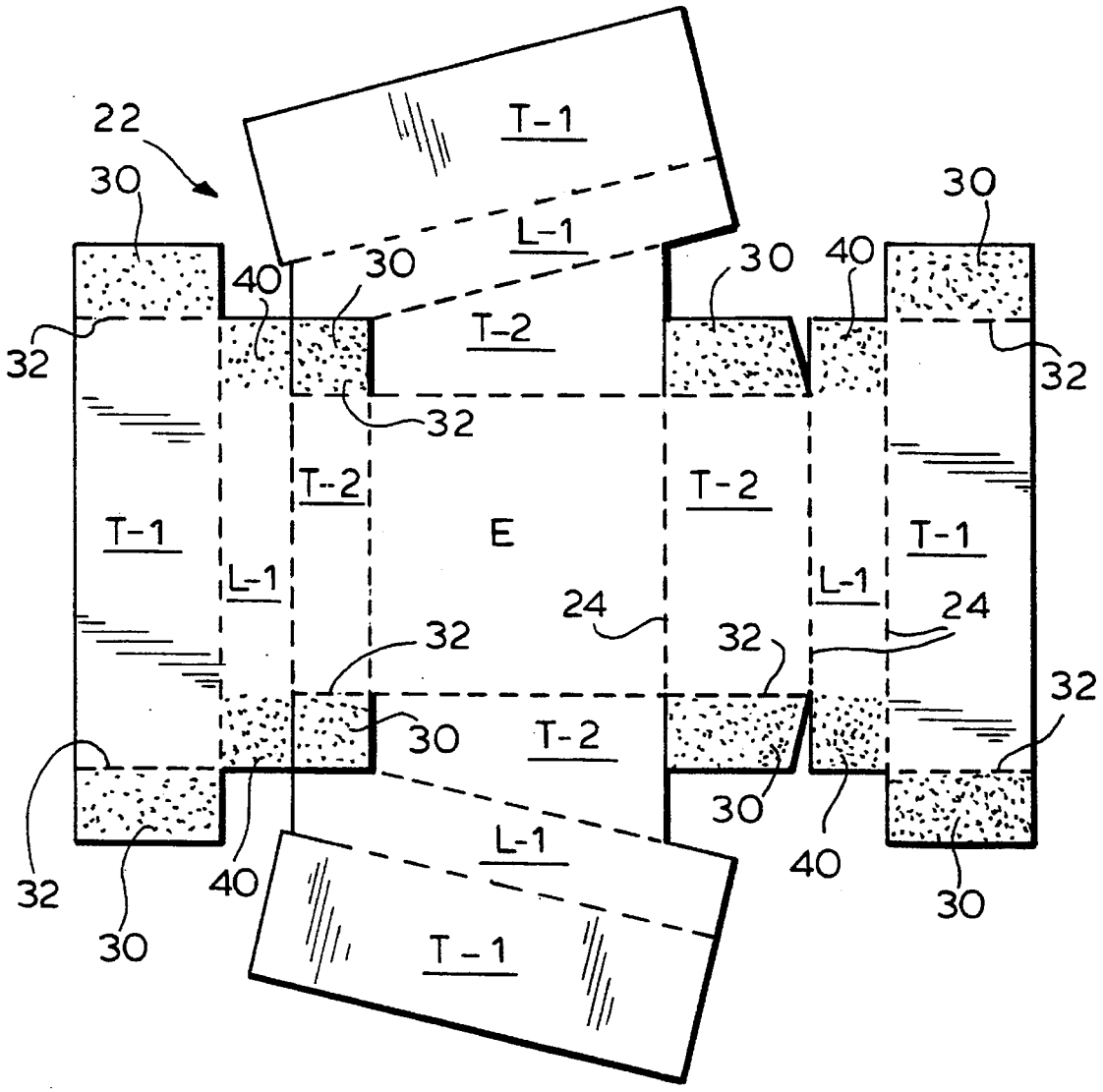
FIG. 10 is a top plan view of a blank for a modified rectangular regressively tiered structure defining at least part of a display package.
Figure 13:
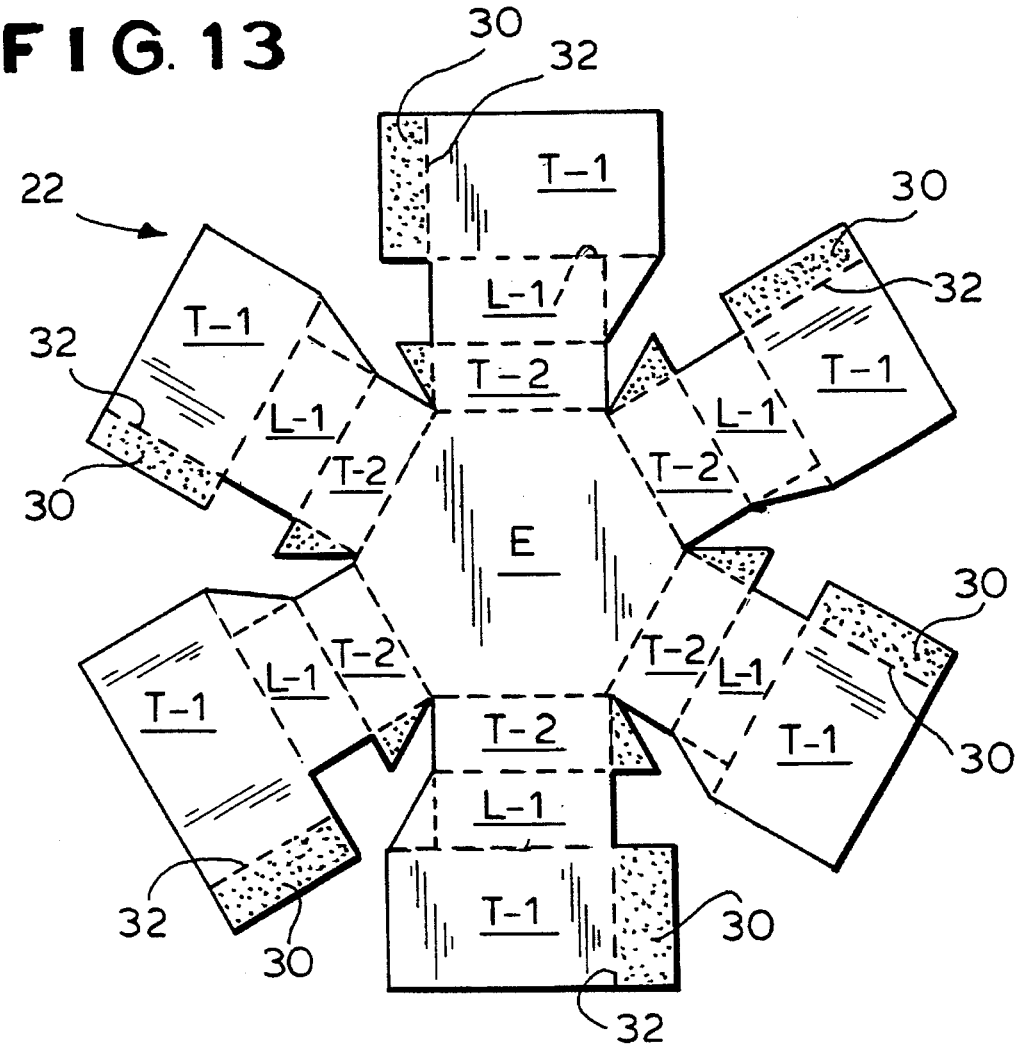
FIG. 13 is a top plan view of a blank for an approximately circular regressively tiered structure defining at least part of a display package.
Figure 14:
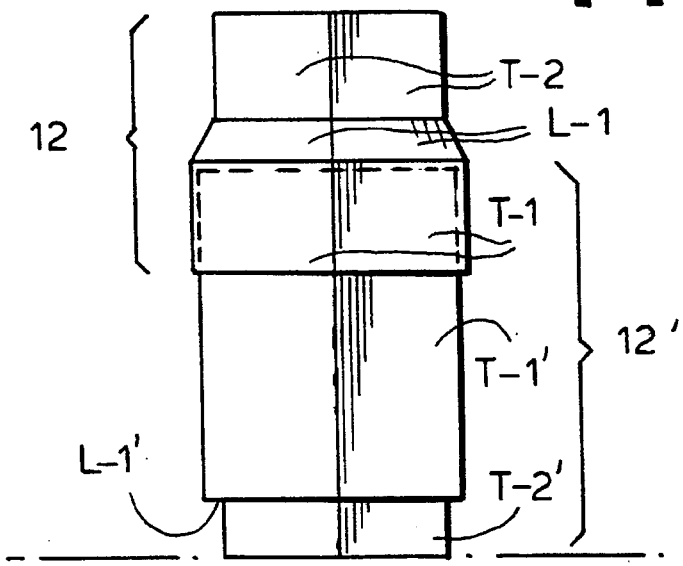

As illustrated in FIGS. 2 and 3, the various figures formed by the tiers typically are substantially vertical and define substantially linear sides (here, the three planar sides forming each triangle). However, as illustrated in FIG. 5, the figures may define outwardly slanting or convex sides for a more interesting design (although preferably no inwardly slanting or concave sides). As illustrated in FIGS. 2 and 3, the ledges are typically substantially horizontal; however, alternatively they may be at an acute angle to the horizontal as illustrated in FIGS. 10–12.

The various tiers and ends of a structure are typically coaxially disposed along a vertical axis passing there through, as illustrated in FIGS. 2–3, 7–9 and 14–16. However, in order to obtain a more interesting design configuration, the tiers and ends may be angularly offset from one another in elevation (see FIGS. 11–12) or in plan (see FIGS. 21–22).

The outer tiers (e.g., T-2) may be of the same, or of a greater or lesser, height than the inner tiers (e.g., T-1) as illustrated in FIGS. 14–16, 7–8 and 2–3, respectively. The outer ledges (e.g., L-2) may be of the same or a greater or lesser width than the inner ledges (e.g., L-1).

Figure 7:
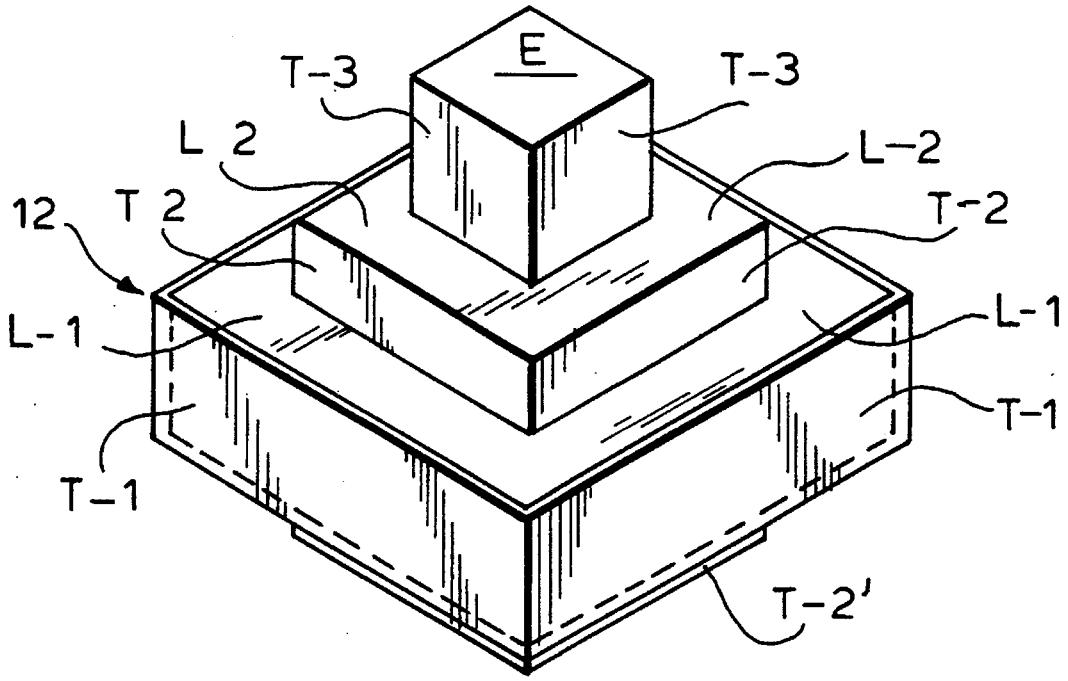
FIGS. 7, 8 and 9 are isometric, side elevational and exploded isometric views, respectively, of a display package incorporating the rectangular structure formed from the blank of FIG. 6.
Figure 8:
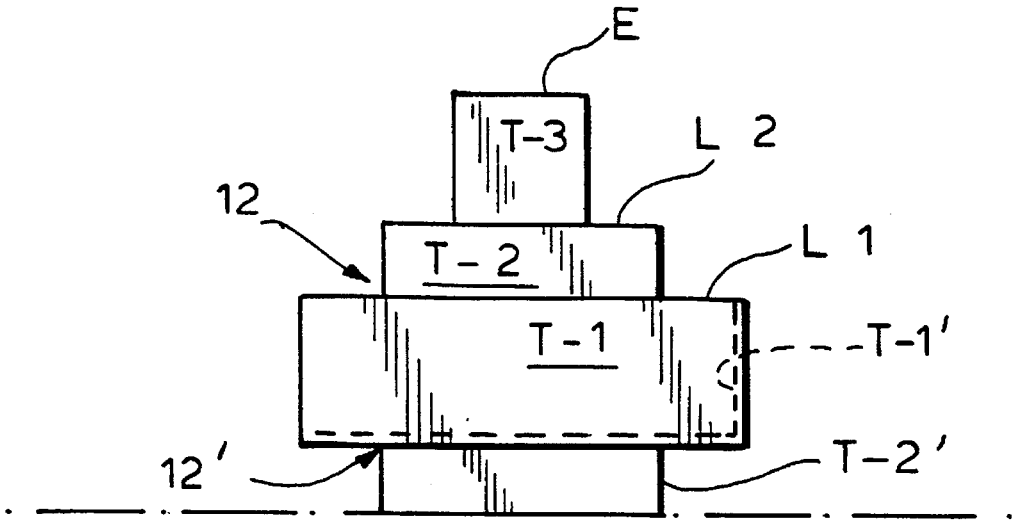
Figure 9:
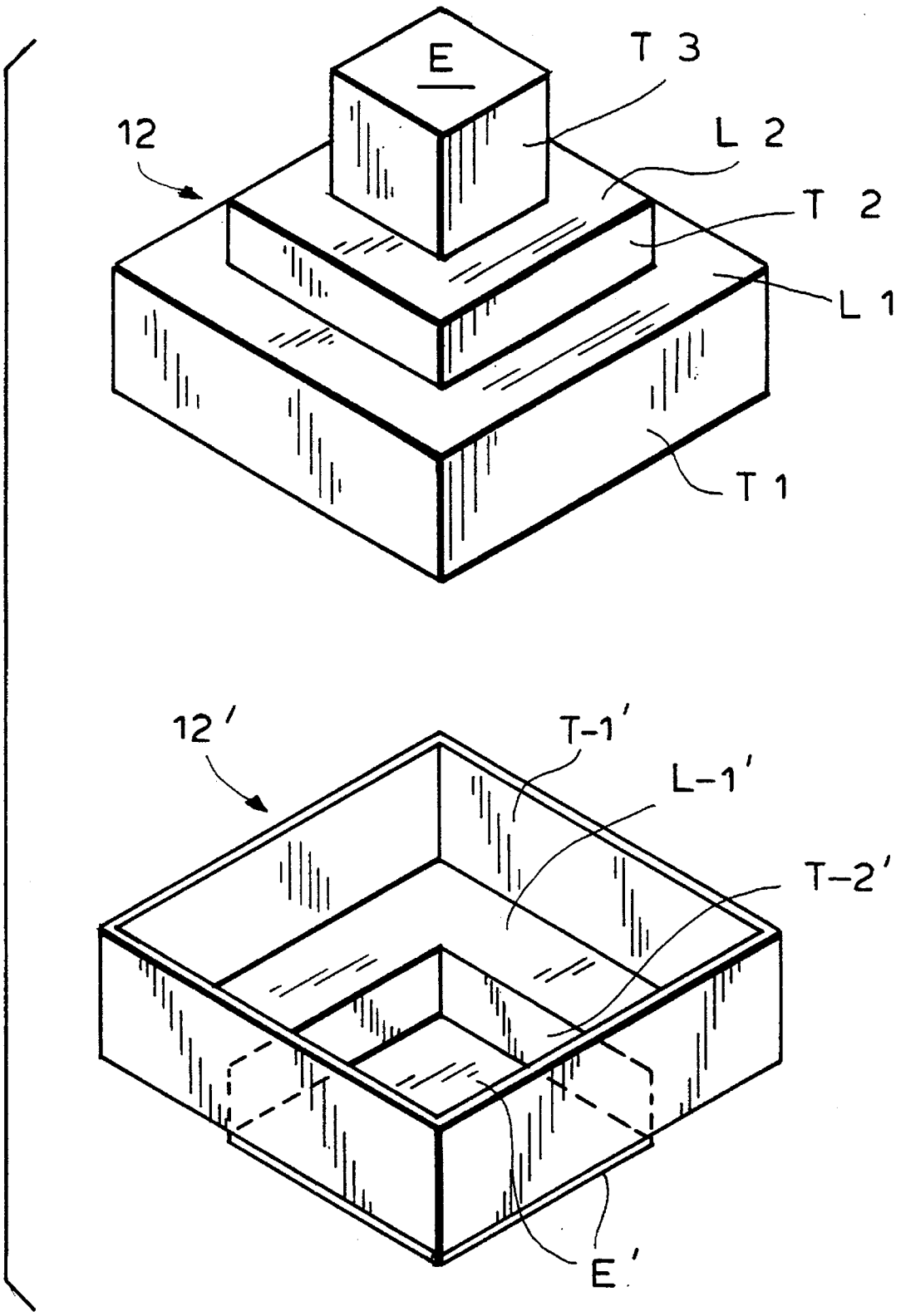

Still referring now to FIGS. 2 and 3, the dimensions of the first tier T-1' of the bottom structure 12' are slightly smaller than the dimensions of the first tiers T-1 of the top structure 12 so that the first tiers T-1 and T-1' of the structures 12, 12' telescope together with the top first tier T-1 on the outside. If desired, the dimensions of the first tier T-1' of the bottom structure 12' may be slightly larger than the dimensions of the first tier T-1 of the top structure 12 so that the first tiers T-1 and T-1' telescope together with the bottom first tier T-1' on the outside (as illustrated in FIGS. 7 and 8 for a quadrangular figure).

Figure 17:
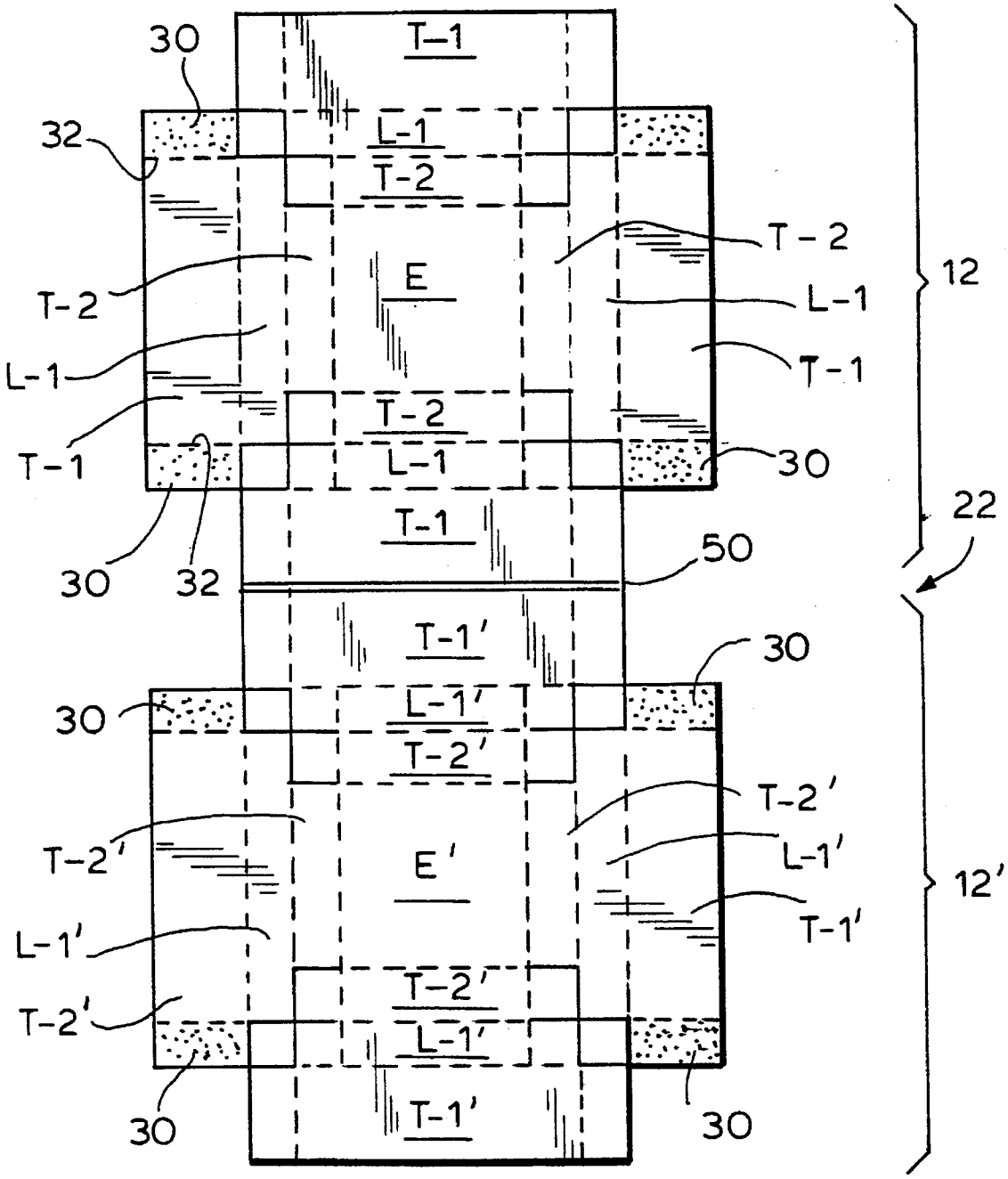
FIG. 17 is a top plan view of a blank for a shell-like structure defining a display package.
Figure 18:
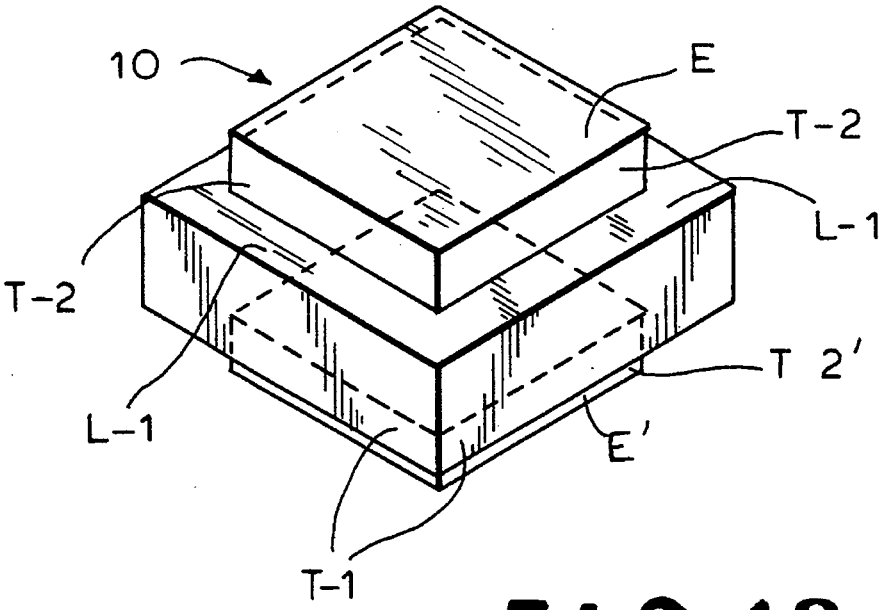
FIGS. 18 and 19 are isometric views of a display package incorporating the structure formed from the blank of FIG. 17, with the package being illustrated in the closed orientation in FIG. 18 and in the open orientation in FIG. 19.
Figure 19:
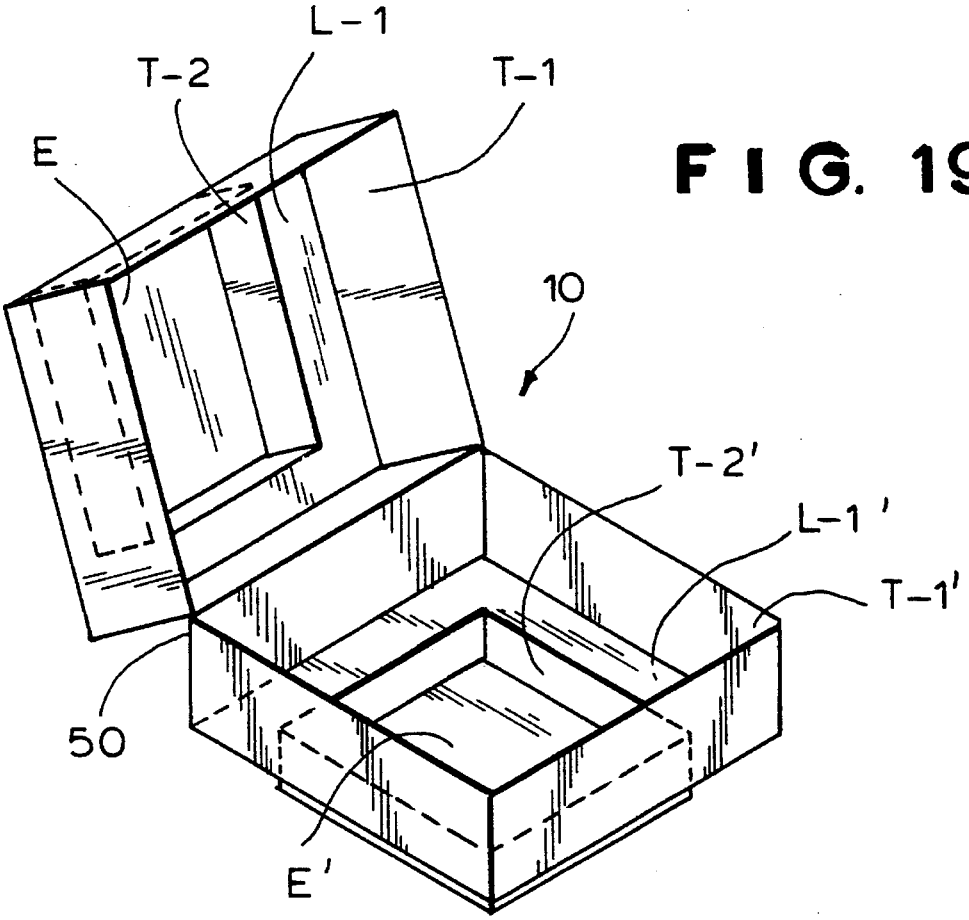
Figure 20:
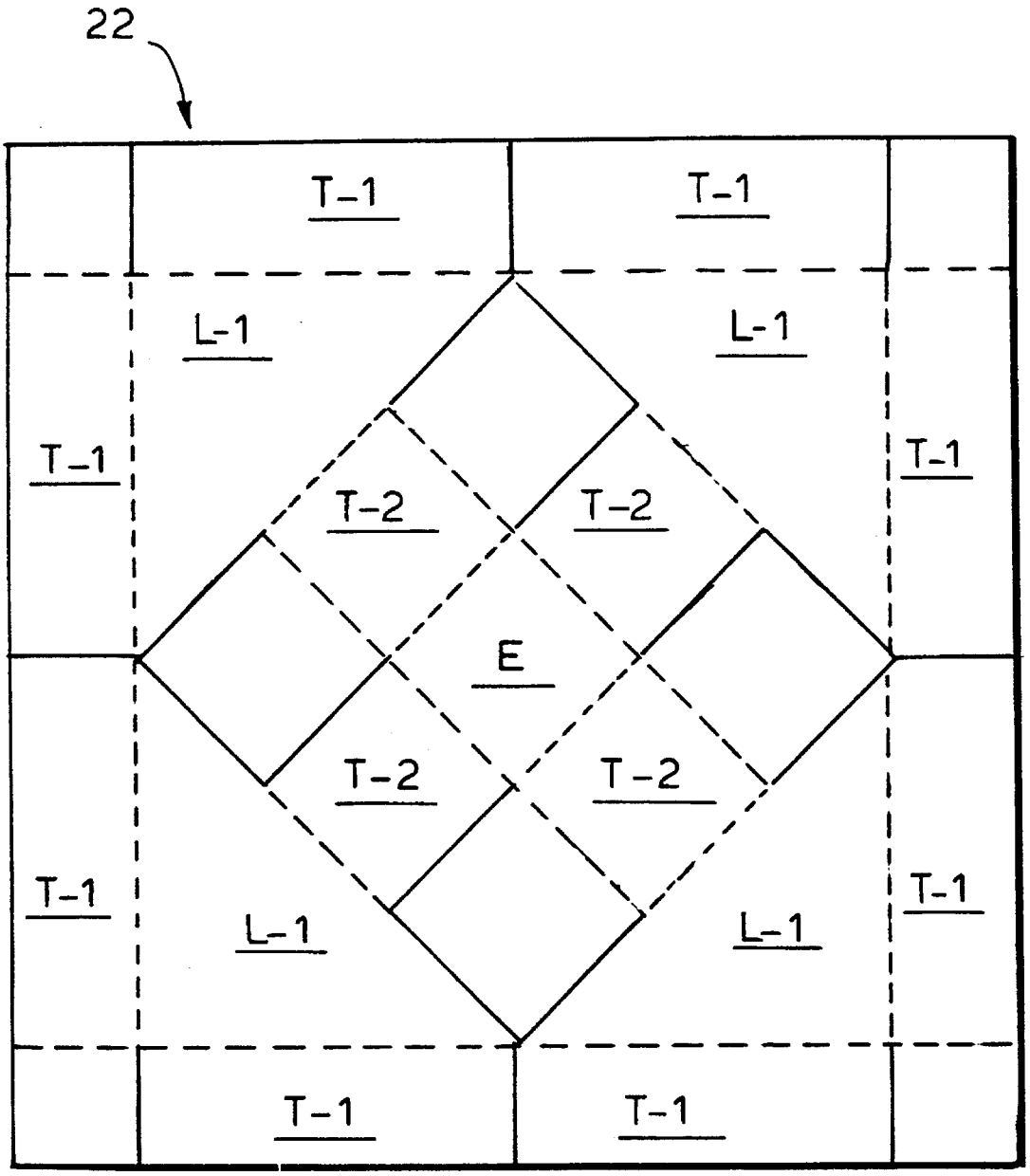
FIG. 20 is a top plan view of a blank for a regressively tiered horizontally skewed structure defining at least part of a display package.

The embodiments of FIGS. 1–16 have separate top and bottom structures 12 and 12' so that the two halves of the package 10 may be totally separated. While separable half portions of a package are quite customary in the packaging art, there are recognized deficiencies in such an arrangement. First, one of the two portions of the package may become lost so that the package cannot be re-used. Second, those with palsied or otherwise shaking hands may find it difficult to align the separated halves of the package so that they may be telescoped. Accordingly, referring now to FIGS. 17–19, one preferred embodiment of the present invention provides a clam shell-like opening and closing package wherein the top and bottom structures 12, 12' are unitary, integral, one-piece construction and define a living hinge 50. The living hinge 50 assists in maintaining the top and bottom structures 12, 12' in appropriate alignment for telescopic action, precludes lose of either structure, and further enhances the economy of the package because both structures thereof are now made from a single sheet.

Each structure is formed from an appropriate blank 22 (see FIGS. 1, 4, 6, 10, 13 and 17) which has been designed to create the specific structure 12 (see FIGS. 2–3, 5, 7–9, 11–12, 14–16 and 18–19, respectively) when erected. Given an appropriate blank 22, the folding thereof to form the corresponding erected structure 12 will be readily apparent to those skilled in the packaging art.

By way of example, a blank 22 typically defines in the center an end E (whether it be the top or bottom end) and extending outwardly therefrom, to each side of the polygon, in turn a section of the tier T-N, a section of the ledge L-(N minus 1), a section of the tier T-(N minus 1), etc., until at the outermost edge is a section of the tier T-1. To erect the structure 12 from the blank 22, on each side of the end E, the tier section T-N is swung about the foldline 24 into a substantially transverse orientation with the plane of the end E (that is, it is swung upward out of the plane of the drawing sheet as illustrated). Thereafter, the ledge section L-(N minus 1) is swung outwardly about the foldline 24 into a substantially transverse orientation with the plane of the tier section T-N (that is, substantially parallel to the plane of the drawing sheet). Then the tier section T-(N minus 2) is swung about the foldline 24 (upward out of the plane of the paper) into a substantially transverse orientation with the ledge section L-(N minus 1), with this procedure being followed for all further ledge and tier sections in the blank 22. Alternatively, depending upon the placement of the glue on the blank 22, the tier sections may be swung downward, below the plane of the drawing sheet as illustrated.

In forming the appropriate blanks 22 for structures 12, 12', special rules will be observed regarding the tiers and ledges.

Referring now to FIG. 1 in particular, one of the two ends of a tier section (here, tier T-1) defines a tab 30 connected to the remainder of the tier section by a foldline 32 and designed to project therefrom at an angle in the erected structure 12. In the erected structure illustrated in FIGS. 2–3, the outer surface of tab 30 is secured to the inner surface of an adjacent tier section T-1 of the same rank or level so that the tab 30 is hidden from view. The glue for securing the tab 30 and the adjacent tier section may be initially disposed on the blank 22 on the outer surface of the tab 30 (the upper surface as illustrated in FIG. 1), or on the inner surface of the adjacent tier section (the lower surface in FIG. 2) which will contacted by the tab 30 in the erected structure 12, or may simply be applied to either or both surfaces during the erecting step.

Figure 6:
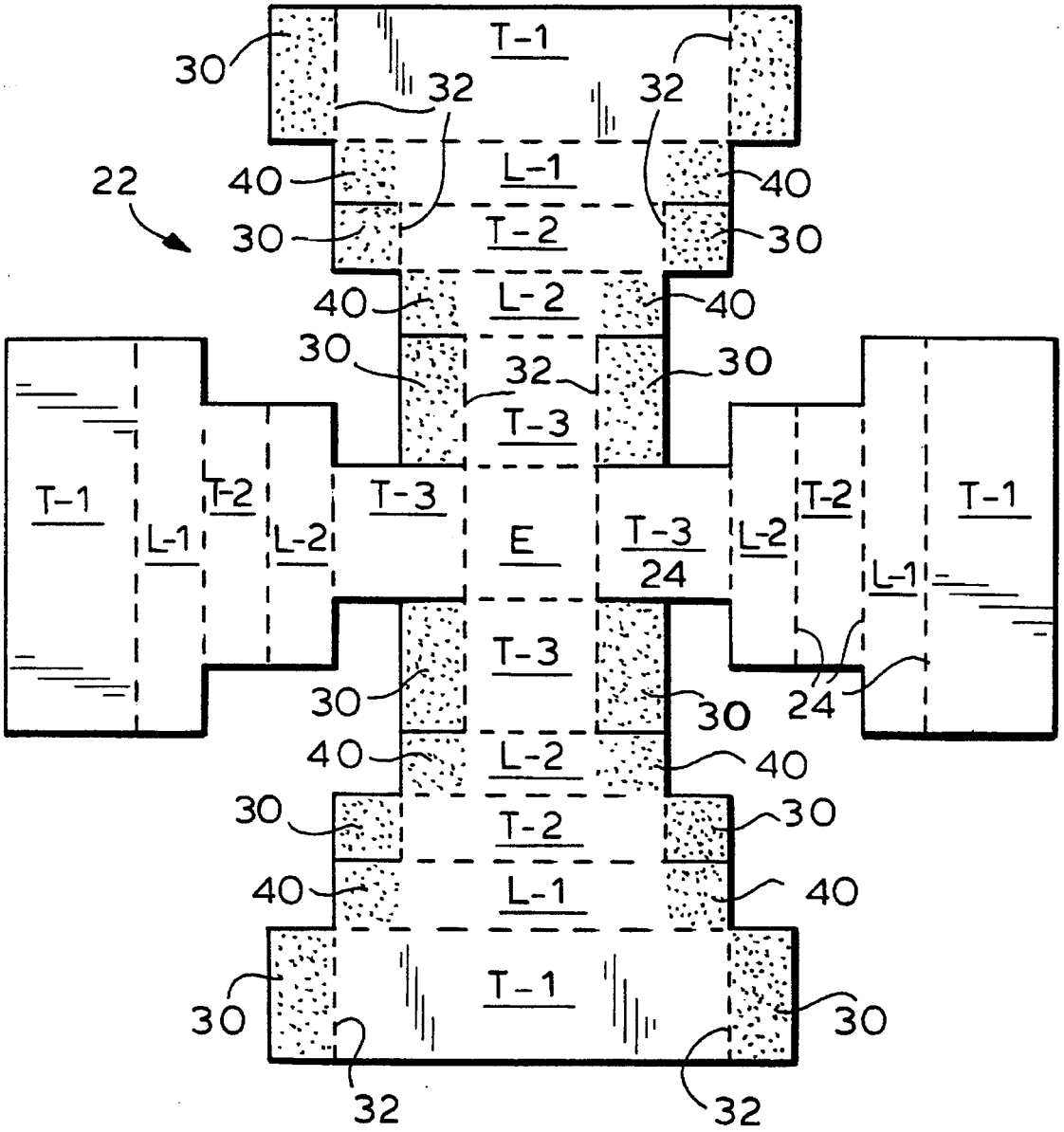
FIG. 6 is a top plan view of a blank for a rectangular regressively tiered structure defining at least part of a display package.

It will be appreciated that while FIG. 1 illustrates the tab 30 at all times being on the clockwise end of a respective tier section T-1, alternatively there may be a tab 30 at each end of a tier section for alternate tier sections of the same level. Thus, as illustrated in FIG. 6, there may be a tab 30 at both ends of a tier section T-1, T-2 or T-3 of alternating sides of the structure—here, the North and South sides, but not the East and West sides).

Alternatively, and still referring to FIG. 1, the free ends 34 of the first and second sides of adjacent tier sections (here, tiers T-2) are disposed so as to form a generally abutting relationship, thereby to define a butt joint 36, typically without being directly secured together. Thus, in the erected carton illustrated in FIGS. 2 and 3, the free ends 34 of the adjacent tier sections T-2 are disposed in a generally abutting relationship and define a butt joint 36 without being directly secured together.

As noted above, each of the several tier sections of a given rank or level in a structure may be joined together by means of tabs 30 and glue or, alternatively, may define butt joints 36, without using glue. Of course, as illustrated in FIGS. 2 and 3, both techniques may be utilized together for different tiers of a single structure—e.g, one technique for tier sections of a first rank or level, and the other technique for tier sections of a second rank or level.

With regard to the ledges, and still referring to FIG. 1, each ledge section defines a pair of ledge ends intended to participate in an overlap with a ledge end of an adjacent ledge section of equal rank or level. (Thus, the ledge end corresponds to tab 30 but without a foldline 32.) Each pair of overlapping ledge ends 40 will preferably have glue on one or the other (or both) of the ledge ends in the blank 22 or the glue may be applied to either or both ledge ends 40 during the erecting step. There may be one glued ledge end 40 per ledge section of the same rank or level (as illustrated in FIGS. 1–3); alternatively, there may be two glued ends 40 for alternate ledge sections of the same rank or level (as illustrated in FIGS. 6–12). In particular applications, the overlapping ledge ends may be formed by a tab somewhat similar to tab 30 in that it is separated from the body of the ledge section by a foldline similar to foldline 32.

Once a particular structure 12 has been created experimentally (even if it requires the use of more than one sheet of flexible material), then a suitable blank 22 for the manufacture of that structure 12 may be designed in a variety of different ways. First, the structure 12 is cut at the corners thereof to produce a flat, substantially planar form. Then, utilizing the rules stated above for the linking of tier sections together and ledge sections together, a variety of different embodiments (having different arrangements and combinations of tier tabs 30 and ledge ends 40) may be created. The various embodiments can be tested for ease of fabrication, strength and the like to determine the most appropriate embodiment of a blank for a structure with the particular appearance desired. Substantial experimentation may be required in order to determine the "best" embodiment of a blank for the production of a structure having a particular appearance, but almost no experimentation at all is required in order to produce several useful and workable embodiments of the blank.

While the packages made according to the present invention may appear to be unstable due to the regressively tiered structure (see FIGS. 3, 8 and 12), in fact the packages are extraordinarily strong and hardy due to the high level of glued overlapping surfaces within a given ledge or tier level.

As already noted, the package 10 is not only a regressively tiered structure, but is also a package with a gripping extension. Referring now to FIGS. 2–3 in particular, therein illustrated is a package with two ergonomic gripping extensions. The bottom structure 12' absent the bottommost tier (here, tier T-2') and its end E' define a hollow container. The container is formed by the first tier T-1', the first ledge L-1', and the end E', has an open top, and defines an open space therein. The top structure 12 absent the topmost tier (here, T-2) and its end E define a hollow cover for closing the container open top. The cover is defined by tier T-1 and the first ledge L-1, has an open bottom, and defines an open space therein. The cover is in plan of the same general configuration and generally the same dimensions as the container, although the first tier of either the cover or the container will be slightly smaller than the first tier of the other to enable telescopic action between the first tiers of the container and the cover. As illustrated in FIGS. 2 and 3, the first tier T-1' of the container is of slightly smaller dimensions than the first tier T-1 of the cover.

The bottommost tier T-2' and its end E' define a gripping extension formed on the container for use in separating the container and the cover, while the topmost tier T-2 and its end E define a gripping extension formed on the cover for use in separating the cover and the container. Each of the gripping extensions is in plan of appreciably smaller dimensions than the one of the cover and container on which it is formed (this being also the general rule for the outermost tiers of the display package).

Even a person with limited manual dexterity can probably grasp either the container and cover (where the user's hand cannot grasp small objects) or the smaller gripping extensions thereon (where the user's hand cannot grasp larger objects). The greater the number of tiers in the structures forming the package, the more likely that there will be a tier (including the gripping extension) which the user can comfortably grasp for opening and closing of the package.

Further, each gripping extension is preferably in plan of the same general configuration as the cover or container on which it is formed, and optimally of substantially the same configuration.

As the various tiers define an open space therein (excepting only the tabs 30 disposed therein), the open space of one gripping extension (formed by the bottommost tier T-1' and its end E') are in communication in the closed package through the container and the cover with the other gripping extension (formed by the topmost tier T-1 and its end E). The provision of ergonomic gripping extensions does not necessarily result in any lost useful volume of the package, as the inner volume of the gripping extensions may be occupied by the product being packaged.

As the top and bottom structures 12, 12' are each formed from a single sheet of flexible material, it follows that the container and the extension formed thereon as well as the cover and the extension formed thereon are each made from a single sheet of flexible material as well.

Accordingly, it will be appreciated that the present invention provides not only an aesthetically innovative, eye-catching and appealing display package, but also a package which has gripping extensions to facilitate opening thereof while allowing the inner volume of the gripping extensions to be occupied by the products being packaged.

Because of the unusual regressively tiered design of the present invention, each half of the package (that is, the top or bottom structure thereof) may be made in a variety of different configurations and dimensions but still be recognizable by the common feature thereof as part of a single design or family of designs.

To summarize, the present invention provides an aesthetically innovative, eye-catching and appealing package in which each half may economically be made from a single sheet of material. The package has in one embodiment gripping extensions to facilitate opening thereof, the inner volume of the gripping extension being available to be occupied by the products being packaged. Each half of the package may be made up of a variety of different configurations and dimensions but still be recognizable by a common feature thereof—namely, its regressive tiering.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A regressively tiered structure defining at least part of a display package, comprising:

(A) a first vertically-extending tier formed of sections and defining in plan a first hollow, polygonal, substantially closed figure having edges;

(B) a second vertically-extending tier formed of sections and defining in plan a second hollow, polygonal, substantially closed figure having edges, said second figure being in plan of appreciably smaller dimensions than said first figure; and (C) a horizontally-extending, generally planar, first ledge formed of sections and disposed intermediate to and connecting the edges of said first and second tiers disposed in generally a common plane;

said first and second tiers and said first ledge being formed from a single sheet of flexible material.

2. The structure of claim 1 wherein said first and second figures are in plan of the same general configuration.

3. The structure of claim 1 wherein said first and second figures are in plan of substantially the same configuration.

4. The structure of claim 1 wherein each of said first ledge sections defines a pair of ledge ends, each pair of adjacent ledge ends being overlapping.

5. The structure of claim 1 wherein each of said sections of at least one tier defines at least first and second ends, said first one of said tier ends defining a tab projecting therefrom at an angle and being secured to the second end of an adjacent tier for defining a joint of said tier.

6. The structure of claim 1 wherein each of said tier sections of at least one tier define at least first and second ends, the ends of said first and second sides of adjacent tiers being disposed in generally abutting relationship to define a butt joint without being directly secured together.

7. The structure of claim 1 wherein said polygonal figures are defined by substantially linear sides.

8. The structure of claim 1 wherein said polygonal figures are defined by at least one convex side.

9. The structure of claim 1 wherein said polygonal figures are triangles.

10. The structure of claim 1 wherein said polygonal figures are rectangles.

11. The structure of claim 1 wherein said polygonal figures approximate cylinders.

12. The structure of claim 1 wherein said first and second tiers are coaxially disposed along an axis passing there through.

13. The structure of claim 1 wherein said first and second tiers are angularly offset from one another in plan.

14. The structure of claim 1 wherein said first and second tiers are angularly offset from one another in elevation.

15. The structure of claim 1 wherein said tiers are substantially vertical.

16. The structure of claim 1 wherein at least one of said tiers is at an acute angle to the vertical.

17. The structure of claim 1 wherein said first ledge is substantially horizontal.

18. The structure of claim 1 wherein said first ledge is at an acute angle to the horizontal.

19. The structure of claim 1 additionally including a closed end for said second tier, said closed end also being formed from said single sheet of material.

20. The structure of claim 1 wherein said second tier is of a greater height than said first tier.

21. The structure of claim 1 additionally including a third vertically-extending tier formed of sections and defining in plan a third hollow, polygonal, substantially closed figure having edges, said third figure being in plan of appreciably smaller dimensions than said second figure; and a horizontally-extending, generally planar second ledge formed of sections and disposed intermediate to and connecting the edges of said second and third tiers disposed in generally a common plane;

said first, second and third tiers and said first and second ledges being formed from a single sheet of flexible material.

22. The structure of claim 21 additionally including a closed end for said third tier, said closed end also being formed from said single sheet of material.

23. The structure of claim 21 wherein said first, second, and third figures are of the same general configuration.

24. The structure of claim 21 wherein said first, second, and third figures are of substantially the same configuration.

25. In combination, a pair of the structures of claim 1 defining together a package.

26. In combination, a pair of the structures of claim 1 wherein the first tier of one structure is adapted to be received at least partially within the first tier of the other structure.

27. In combination, a pair of the structures of claim 1 defining together a package with one side of one structure defining a living hinge with one side of the other structure, thereby to enable a clam shell-like opening and closing of said package.

28. The structure of claim 1 wherein said flexible material is paper or cardboard.

29. A regressively tiered structure defining at least part of a display package, comprising:

(A) a first, vertically-extending tier formed of sections and defining in plan a first hollow, polygonal, substantially closed figure defining edges;

(B) a second vertically-extending tier formed of sections and defining in plan a second hollow, polygonal, substantially closed figure defining edges, said second figure being in plan of the same general configuration as, but of appreciably smaller dimensions than, said first figure;

said polygonal figures being defined by substantially linear sides, said first and second tiers being coaxially disposed along an axis passing there through, said tiers being substantially vertical, and said first ledge being substantially horizontal;

(C) a horizontally-extending, generally planar, first ledge formed of sections and disposed intermediate to and connecting the edges of said first and second tiers disposed in generally a common plane, said first ledge defining a plurality of overlapping ledge ends; and (D) a closed end for the smallest tier in plan;

said first and second tiers, said closed end, and said first ledge being formed from a single sheet of flexible material.

30. The structure of claim 29 additionally including a third vertically-extending tier formed of sections and defining in plan a third hollow, polygonal, substantially closed figure defining edges, said third figure being in plan of the same general configuration as, but of smaller dimensions than, said second figure; and a horizontally-extending, generally planar second ledge formed of sections and disposed intermediate to and connecting the edges of said second and third tiers disposed in generally a common plane;

said first, second and third tiers, said closed top, and said first and second ledges being formed from a single sheet of flexible material.

31. In combination, a pair of the structures of claim 29 defining together a package.

32. The structure of claim 29 wherein said flexible material is paper or cardboard.

33. A package with a pair of gripping extensions, comprising:

(A) a hollow container having an open top and defining an open space therein;

(B) a cover for closing said container open top, said cover having an open bottom and defining an open space therein, said cover being in plan of the same general configuration and generally the same dimensions as said container; and (C) a pair of gripping extensions for use in separating said cover and said container, each gripping extension being formed on a respective one of said cover and said container, each of said gripping extensions being in plan of the same configuration as, but of appreciably smaller dimensions than, the respective one of said cover and container on which it is formed, each of said gripping extensions defining an open space therein in communication with said open space of said respective one of said container and cover, said open spaces of said gripping extensions being in communication in the closed package through said container and said cover;

said container and said gripping extension formed thereon being made from a single sheet of material, and said cover and said gripping extension formed thereon being made from a single sheet of material.

34. The package of claim 33 wherein said material is paper or cardboard.

35. A package with a gripping extension, comprising:

(A) a hollow container having an open top and defining an open space therein;

(B) a cover for closing said container open top, said cover having an open bottom and defining an open space therein, said cover being in plan of the same general configuration as said container; and (C) a gripping extension for use in separating said cover and said container, said gripping extension being formed on one of said cover and said container, being in plan of the same configuration as, but of appreciably smaller dimensions than, the one of said cover and container on which it is formed, and defining an open space therein in communication with said open space of said one of said container and cover on which it is formed, said open space of said gripping extension being in communication in the closed package with said open spaces of said container and said cover;

said gripping extension and said one of said container and cover on which it is formed being made from a single sheet of material.

36. The package of claim 35 wherein said material is paper or cardboard.

* * * * *